US006670534B2

(12) United States Patent
Vildosola Erdociain

(10) Patent No.: US 6,670,534 B2
(45) Date of Patent: Dec. 30, 2003

(54) DAMPED TENSOR RING

(76) Inventor: José Ignacio Vildosola Erdociain, Calle Roncal, 10 - 2°, E-31580 Lodosa (ES)

( * ) Notice: Subject to any disclaimer, the term of this patent is extended or adjusted under 35 U.S.C. 154(b) by 0 days.

(21) Appl. No.: 10/149,863

(22) PCT Filed: Dec. 12, 2000

(86) PCT No.: PCT/ES00/00467

§ 371 (c)(1),
(2), (4) Date: Jun. 13, 2002

(87) PCT Pub. No.: WO01/44759

PCT Pub. Date: Jun. 21, 2001

(65) Prior Publication Data

US 2003/0079597 A1 May 1, 2003

(30) Foreign Application Priority Data

Dec. 17, 1999 (ES) ..... 9902756

(51) Int. Cl.[7] ..... G10D 9/02
(52) U.S. Cl. ..... 84/383 R; 84/380 R; 84/384; 84/453
(58) Field of Search ..... 84/383 R, 380 R, 84/382, 453

(56) References Cited

U.S. PATENT DOCUMENTS 1,016,055 A * 1/1912 Winquist ..... 84/383 R
2,811,888 A * 11/1957 Stone ..... 84/383 R
3,202,032 A * 8/1965 Strathmann ..... 84/383 R
4,941,385 A * 7/1990 Johnson ..... 84/383 R
5,623,111 A 4/1997 van Doren et al. ..... 84/383 R
5,728,957 A 3/1998 Valtchev ..... 84/383 R
5,998,715 A * 12/1999 Rovner ..... 84/383 R

FOREIGN PATENT DOCUMENTS

| | | |
|---|---|---|
| EP | 0604267 | 6/1994 |
| EP | 0957469 | 11/1999 |
| ES | 2145887 | 5/1996 |

* cited by examiner

*Primary Examiner*—Shih-Yung Hsieh
(74) *Attorney, Agent, or Firm*—Ostrolenk, Faber, Gerb & Soffen, LLP

(57) ABSTRACT

This consists of a spring (2.1) that raises or descends an turning the screw (2.2), which becomes endless to move the riveted nut (2.3) that, in turn, serves as a closure of the spring. On the point of the screw and the base of the spring two dampers (2.4 and 2.5) are fastened in such a way they permit the mouthpiece and reed of the wind instruments of the clarinet and saxophone families to be secured between both elements, touching the dampers only to avoid the transmission of vibrations to the set, thus reducing the contact surface with the results that the same set is valid for any instrument.

Possible changes in the shape and material of the spring (2.1) and the dampers (2.4 and 2.5) have been envisaged so that the way of tightening, the position and contact surface with the reed and mouthpiece can be varied.

7 Claims, 5 Drawing Sheets

DAMPED TENSOR RING

CROSS REFERENCE TO RELATED APPLICATIONS

This application is based on and claims priority to international application PCT/ES00/00467, filed Dec. 12, 2000, which in turn, is based on and claims priority to application ES P9902756, filed Dec. 17, 1999.

BACKGROUND OF THE INVENTION

1. Field of the Invention

This invention consist of a new system for keeping the reed next to the mouthpiece in wind instruments of the clarinet and saxophone families, thanks to which great improvements are achieved as regards other system used up to now.

The improvements affect both the easiness provided when emitting low notes as well as the fullness of the sound.

2. Description of Related Art

A bracket system that maintains the reed fastened to the mouthpiece on reducing the diameter of the bracket when one or more screws are tightened has been used to date.

These systems have various disadvantages as a result of their design that affects the working and the sound of the instrument. Their basic characteristics are as follows: a bracket of a different size is needed for each member of the clarinet and saxophone families. When the mouthpiece and/or reed makes contact with the bracket, this receives part of its vibration trough transmission; the read becomes strangled against the mouthpiece when the diameter of the bracket is reduced, contrary to what would be ideal in maintaining it free of any pressure.

To avoid the inconveniences of this type, the owner of this invention has developed a new system to maintain the reed next to the mouthpiece, the main characteristics of which are as follows: the ring itself is valid for all the members of the clarinet and saxophone families; the reed and mouthpiece only come into contact with the damper of the spring and the screw and not with the spring; and the reed ascends from its base and maintained suspended underneath the mouthpiece without forcing.

BRIEF SUMMARY OF THE INVENTION

The cushioned tightener ring is composed of the following five components: spring (2.1), screw (2.2), riveted nut (2.3), damper of the screw (2.4) and damper of the spring (2.5).

The spring (2.1) is made of one wire part only with a design in the shape of a ring (3.1), slanted as regards the base (4.1), that ends up joining both ends in a head forming a gudgeon (5.1) that is attached with a riveted nut (2.3).

The riveted nut (2.3) closes the spring (2.1) and makes it rise or descend by sliding along the screw (2.2), which becomes endless when its point (8.1) turns on the damper (2.4) inserted in it so that it rests on the mouthpiece, managing to raise the base of the spring (4.1), which has another damper (2.5) inserted in it so that it rests on the reed with minimum contact, maintaining it suspended underneath the mouthpiece without forcing.

Due to the slant of the spring when it is made to rise on turning the screw, the back part of the base (4.2) is the first that rests on the reed, permitting the tension of the spring on the front part (4.3) to be adjusted and, consequently, the pressure of the reed on the front part.

BRIEF DESCRIPTION OF THE DRAWINGS

For a better understanding of the description in this report, attached are drawings in which a practical case of performance of the cushioned tightener ring and its components is represented as an example.

In said drawings.

DETAILED DESCRIPTION OF THE INVENTION

Figure 1:
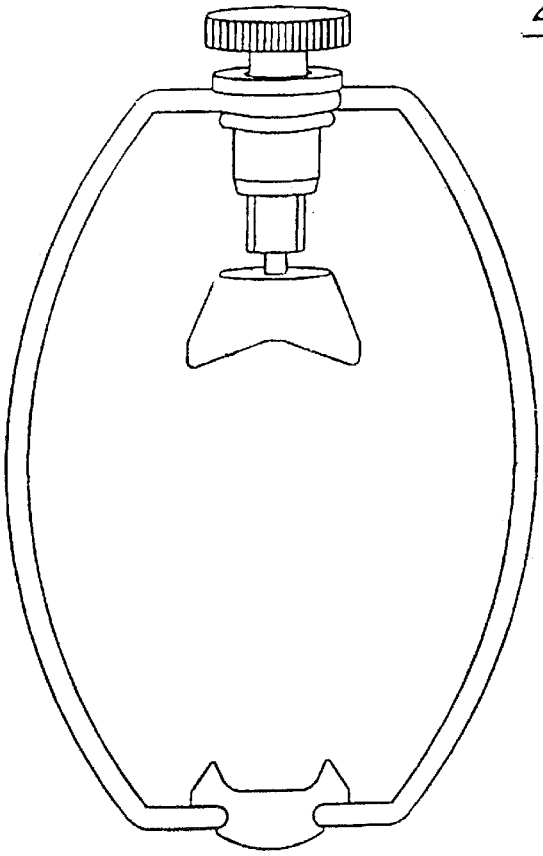
FIG. 1 is an elevated view of the mounted set.
Figure 2:
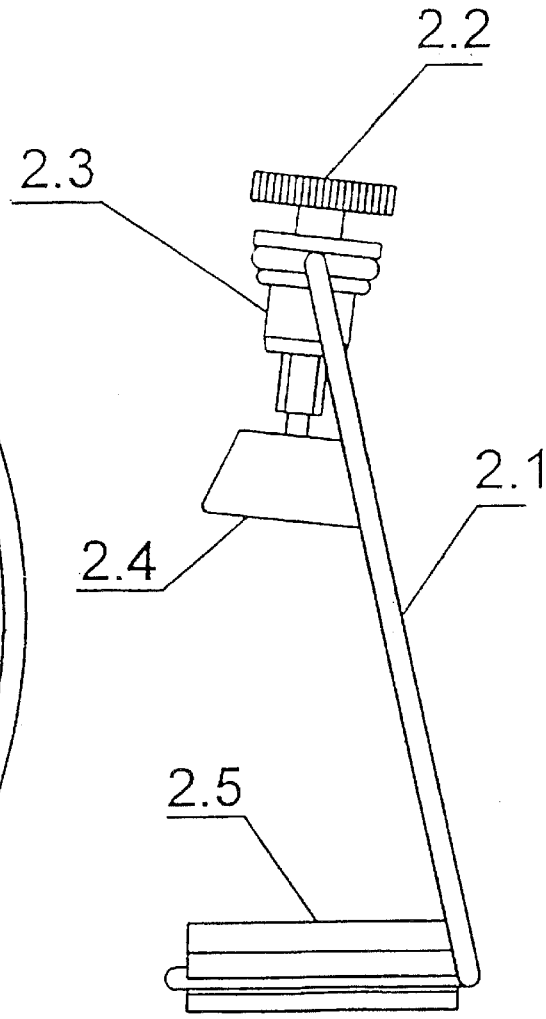
FIG. 2 is a lateral view of the mounted set.
Figure 3:
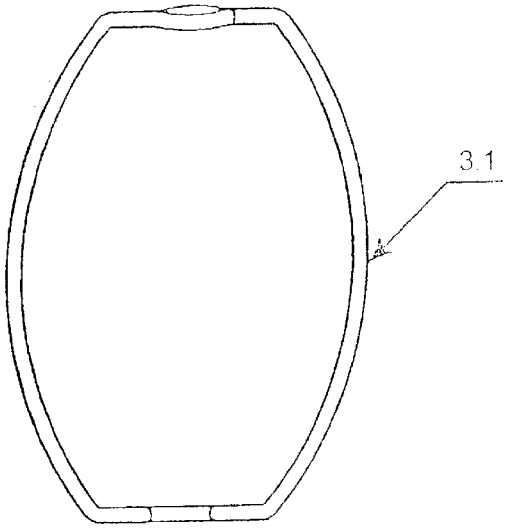
FIG. 3 is an elevated view of the spring.
Figure 4:
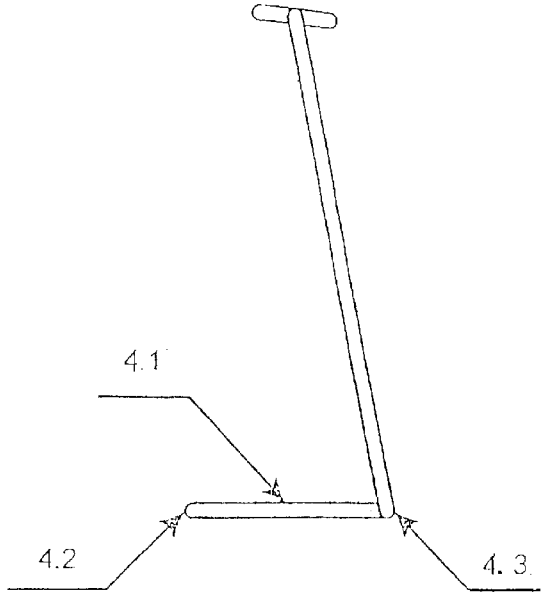
FIG. 4 is a lateral view of the spring.
Figure 5:
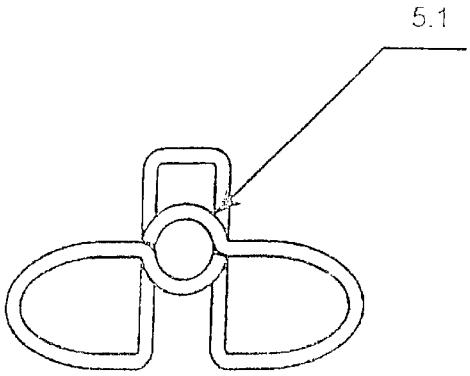
FIG. 5 is a floor view of the spring.
Figure 6:
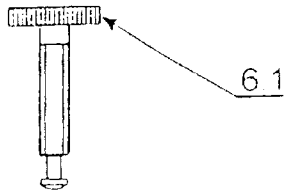
FIG. 6 is an elevated view of the screw.
Figure 7:
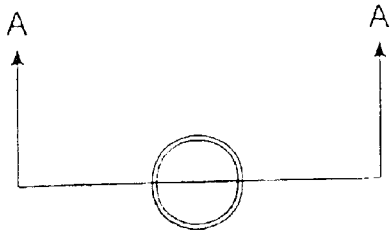
FIG. 7 is a floor view of the screw.
Figure 8:
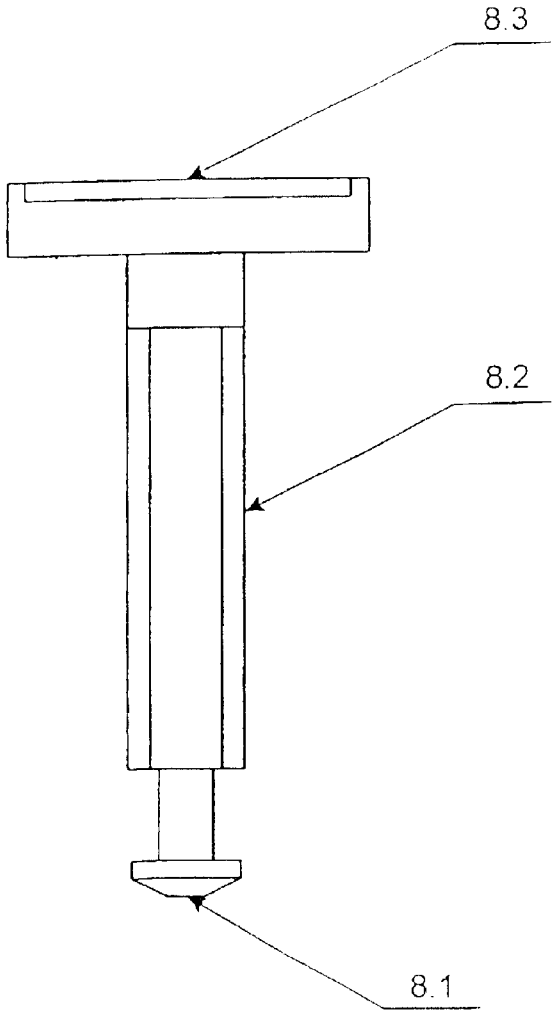
FIG. 8 is the A—A section of FIG. 7.
Figure 9:
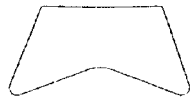
FIG. 9 is an elevated view of the screw damper.
Figure 10:
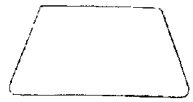
FIG. 10 is a lateral view of the screw damper.
Figure 11:
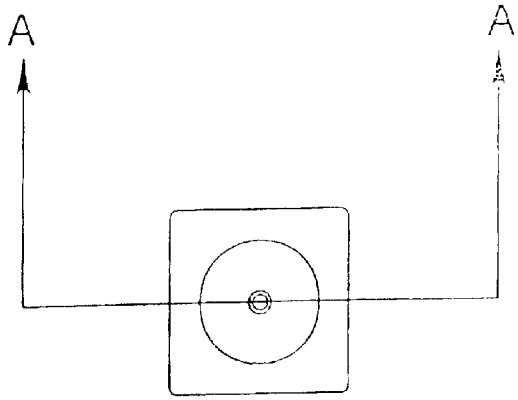
FIG. 11 is a floor view of the screw damper.
Figure 12:
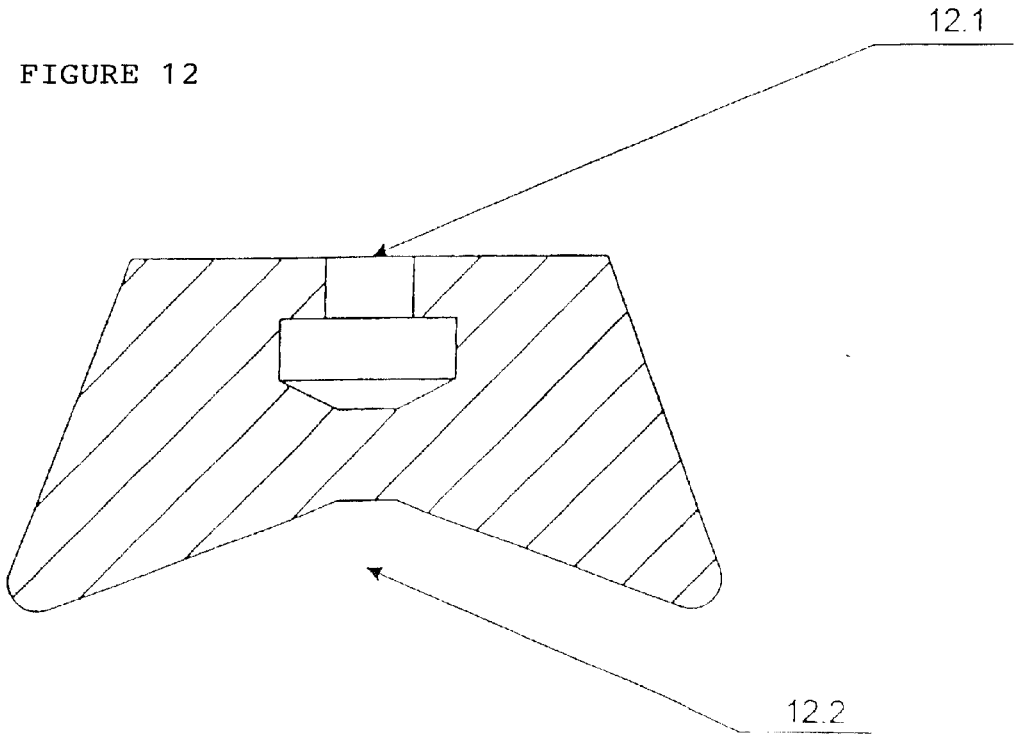
FIG. 12 is the A—A section of FIG. 11.
Figure 13:
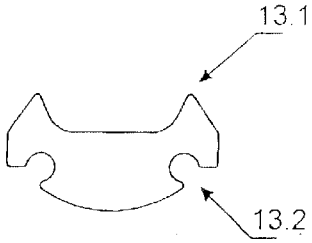
FIG. 13 is an elevated view of the spring damper.
Figure 14:
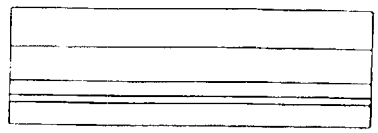
FIG. 14 is a lateral view of the spring damper.
Figure 15:
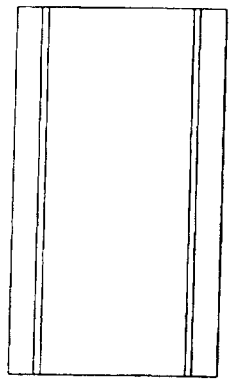
FIG. 15 is a floor view of the spring damper.

The cushioned tightener ring in question consists of a spring (2.1) made of one metallic wire part only with a design in the shape of a ring (3.1) to avoid the contact with the mouthpiece. It has a base on is middle part (4.1) where the damper of the spring (2.5) can be inserted to end up next to both ends in ahead forming a gudgeon (5.1), which is attached with a standard riveted nut (2.3) with a flat head and cylindrical, polished and open body; a screw (2.2) made of plastic or turned metal coming out if the polished bar (6.1) to improve the contact with the fingers when it turns, with a screwed body (8.2), trough which the riveted nut (2.3) moves, in the shape of a point (8.1) where the damper of the screw (2.4) is inserted and turned and with a groove on the upper part of the head (8.3) for sticking or marking a distinctive sign; a damper (2.4) made of injected or hardness extruded EPDM between 70° and 90° shore with its upper part (12.1) shaped so that the point of the screw (8.1) can be inserted without preventing it turning. It has a base formed by two sloped planes (12.2) so that it can adapt to the different diameters of the mouthpiece and rest on them without moving; and a damper (2.5) made of extruded or hardness injected EPDM between 70° and 90° shore, with it upper part (13.1) formed by two relief lines where the reed rests and a base (13.2) that can be inserted into the base of the spring (4.1), which can be replaced by another damper with different point of contact with the reed.

What is claimed is:

1. A cushioned tightener ring comprising a spring in the shape of a ring for surrounding a reed and a mouthpiece without coming into contact therewith, a thread on the upper part of the spring allowing the spring to move through the action of a screw, a first damper inserted at the endpoint of the screw and which becomes endless when turned and resting perpendicularly on the mouthpiece and a second damper inserted in a raised base of the spring which serves as a support for the reed, maintaining the reed suspended underneath the mouthpiece with minimum pressure so that the reed does not move.

2. A ring according to claim 1, wherein the base of the spring is formed on its middle part opposite the thread of the spring and that the base is slanted acute-angled to the ring.

3. A ring according to claim 2, wherein the thread is formed by a riveted nut arranged on the upper part of the spring.

4. A ring according to claim 1, wherein the thread is formed by a riveted nut arranged on the upper part of the spring.

5. A ring according to claim 1, wherein the first damper is made of injected or extruded EPDM between 70° and 90° shore and has an upper part shaped so that the endpoint of the screw can be inserted without preventing the screw from turning, and further including:

an under part formed by two sloped planes so that the ring can adapt to different diameters of the mouthpiece and rest thereon without moving.

6. A ring according to claim 1, wherein the second damper is made of extruded or injected EPDM between 70° and 90° shore and has an upper part formed by two relief lines where the reed rests, and further including a lower part that can be inserted into the base of the spring.

7. A ring according to claim 1, wherein the ring is used for members of the clarinet and saxophone families.

* * * * *